US009283588B2

(12) United States Patent
Mizuno et al.

(10) Patent No.: US 9,283,588 B2
(45) Date of Patent: Mar. 15, 2016

(54) APPLICATION HEAD AND DROPLET APPLYING APPARATUS

(71) Applicant: TDK Corporation, Tokyo (JP)

(72) Inventors: Toru Mizuno, Tokyo (JP); Osamu Shindo, Tokyo (JP); Masaya Wada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 462 days.

(21) Appl. No.: 13/864,415

(22) Filed: Apr. 17, 2013

(65) Prior Publication Data

US 2013/0277457 A1 Oct. 24, 2013

(30) Foreign Application Priority Data

Apr. 20, 2012 (JP) ..... 2012-096161
Dec. 6, 2012 (JP) ..... 2012-267241

(51) Int. Cl.
*B05C 5/02* (2006.01)
*B05C 11/10* (2006.01)

(52) U.S. Cl.
CPC ..... *B05C 5/02* (2013.01); *B05C 5/0233* (2013.01); *B05C 11/1034* (2013.01); *Y10T 137/86863* (2015.04)

(58) Field of Classification Search
CPC ..... B05C 5/02; B05C 5/0233; B05C 5/0225; B05C 11/1013; B41J 2/045; Y10T 137/86863; Y10T 137/86871
USPC ..... 239/337, 581.1, 584, 574, 578
See application file for complete search history.

(56) References Cited

U.S. PATENT DOCUMENTS 6,024,299 A * 2/2000 Drozkowski ..... B05B 7/0861 239/290
2007/0119368 A1* 5/2007 Perttila ..... B05C 5/0275 118/300
2009/0236366 A1 9/2009 Ikushima
2010/0177138 A1* 7/2010 Ikushima ..... B05C 5/0225 347/19

FOREIGN PATENT DOCUMENTS

JP 2004-19593 A 1/2004

* cited by examiner

*Primary Examiner* — Arthur O Hall
*Assistant Examiner* — Juan C Barrera
(74) *Attorney, Agent, or Firm* — Leydig, Voit & Mayer, Ltd.

(57) ABSTRACT

An application head includes a storage-side valve, a discharge-side valve and a plunger. The storage-side valve slides in a space in communication with an intermediate liquid passage between the storage-side valve and the discharge-side valve and changes the volume of liquid in the intermediate liquid passage. Each of the storage-side valve and the discharge-side valve has a column-shaped part, includes a through-hole penetrating between outer circumferential surfaces of the column-shaped part, and is rotatable at least within a predetermined angular range around a center axis of the column-shaped part. Each of the through-holes of the storage-side valve and the discharge-side valve communicates with liquid passages on both sides at a predetermined rotational position and does not communicate with the liquid passage on both sides at other rotational positions outside the angular range.

25 Claims, 12 Drawing Sheets

Z
X
Y
P
50
51
19
10
11
12a
13a
14
15
12b
13b
18a
18b
18c
18
120a
20a
120b
20b
16
17
体積
V
VOLUME

APPLICATION HEAD AND DROPLET APPLYING APPARATUS

BACKGROUND OF THE INVENTION

1. Field of the Invention

The present invention relates to an application head and a droplet applying apparatus applying a predetermined amount of liquid (droplet) such as resin or adhesive to an object to be coated.

2. Description of the Related Art

In the electronic components industry, droplet applying apparatuses are required to apply a droplet to an object to be coated at high speed and an accurate application amount (discharge amount). At the same time, since a droplet remaining at a tip of a nozzle clogs the nozzle or causes a discharged droplet to attach to the nozzle again, management of the droplet applying apparatuses is also an important problem. Arrangement of a plurality of application heads in a droplet applying apparatus is conceived as a technique of speed-up and, therefore, downsizing and thinning of the application heads are also required.

Since it is difficult to stably discharge an already required accurate application amount with a pressure air type applying apparatus having a relatively simple structure, systems with a mechanical structure having less variation are under study. Application of a plunger type applying apparatus is considered as one of those systems.

Japanese Laid-Open Patent Publication No. 2004-019593 (first patent document) describes a reciprocating pump having a plunger reciprocating in a pump chamber formed in a pump head, a first check valve disposed in a vicinity of a port of a suction flow passage as a suction valve, and a second check valve disposed in a vicinity of a port of a discharge flow passage as a discharge valve, wherein a suction pipe and a discharge pipe can be connected to the upstream side of the suction valve and the downstream side of the discharge valve, respectively. The check valves form a sub-flow passage generating a pressure difference in the axial direction of a main valve element by a fluid flow, and a sub-valve element is disposed in a sub-valve chamber.

An object of International Publication No. 2007-046495 (second patent document) is to provide a liquid material ejector that has a structure without any unnecessary projection and spread of the ejector in the horizontal direction with respect to the advancing/retracting direction of a plunger while being able to handle a liquid material of any viscosity and that enables linkage of a plurality of ejectors. The liquid material ejector is made up of a liquid material supply opening for supplying a liquid material, a nozzle for ejecting the liquid material, a valve block having a weighing hole to be filled with ejected liquid material and a liquid material supply channel communicating with the liquid material supply opening, a switching valve having a first channel for allowing communication between the weighing hole and the liquid material supply channel and a second channel for allowing communication between the weighing hole and the nozzle, a plunger advancing/retracting in the weighing hole, a plunger driving unit for driving the plunger, a valve driving unit for actuating the switching valve, and a transmitting unit transmitting a drive force from the valve driving unit to the switching valve. The liquid material ejector is characterized in that the plunger driving unit, the valve driving unit, and the valve block are arranged sequentially in the longitudinal direction.

In the first patent document, the respective check valves (non-return valves) are disposed on the suction side and the discharge side and the pump chamber (cavity) and the plunger are provided between the non-return valves. Assuming that the cavity is filled with liquid and that the liquid is always supplied to the suction side at a predetermined pressure, the liquid is supplied from the suction side when the volume of the cavity increases due to plunger operation and the liquid is discharged from a discharge opening when the volume of the cavity decreases due to plunger operation. In the case of the first patent document, the sub-flow passage is disposed for improving the response of the non-return valves. However, a method using the non-return valves cannot realize the accurate application amount (discharge amount) required in the electronic components industry. Specifically, with the processing capacity of the non-return valve system, it is difficult to achieve one shot per one second or less than one second and it is difficult to achieve highly-accurate discharge (with variation of 0.5% or less) at a minute amount (e.g., 0.005 ml or less).

In the second patent document, the switching valve rotatable is included, and a concave groove of the switching valve acts as a supply side and a through hole of the switching valve acts as a discharge side, and are switched to fill the weighing hole (cavity) with liquid so that movement of a plunger rod projecting into the cavity changes the volume in the cavity to discharge the liquid. It is described that this configuration enables reduction in size of the application head and sequential arrangement of a multiplicity of nozzles as the effects of the invention of the second patent document. However, in the case of the second patent document, because of the structure causing the concave groove and the through-hole of single switching valve to act as the supply side and the discharge side, respectively, a state of the switching valve must be selected from only two types, i.e., either communication only on the supply side or communication only on the discharge side, which is inconvenient since air removable and washing of a liquid passage (flow passage) are made difficult.

SUMMARY OF THE INVENTION

The present invention has been made in view of the foregoing circumstances and problems, and an object thereof is to provide an application head and a droplet applying apparatus capable of realizing an accurate application amount as compared to a method using non-return valves and capable of preventing inconvenience due to a structure causing a concave groove and a through-hole of single switching valve to act as a supply side and a discharge side, respectively.

In an aspect of the present invention, an application head include: a liquid storage unit storing liquid and having a predetermined pressure applied to the inside; a tip discharge opening discharging a droplet; a liquid passage from the liquid storage unit to the tip discharge opening; a storage-side valve inserted into the liquid passage; a discharge-side valve inserted in the liquid passage on the downstream side relative to the storage-side valve; and a plunger sliding in a space in communication with an intermediate liquid passage that is a liquid passage between the storage-side valve and the discharge-side valve to change a volume of liquid in the intermediate liquid passage. Each of the storage-side valve and the discharge-side valve has a column-shaped part, is provided with a through-hole penetrating between outer circumferential surfaces of the column-shaped part, and is rotatable at least within a predetermined angle range around a center axis of the column-shaped part. The through-holes of the storage-side valve and the discharge-side valve each communicates with the liquid passage on both sides at a predetermined rotational position and does not communicate with the liquid passage on both sides at the other rotational positions.

The application head may be capable of a discharge operation of discharging a predetermined amount of a droplet from the tip discharge opening by utilizing a volume change of the liquid in the intermediate liquid passage. The volume change may be made by, after air removal of the liquid passage from the liquid storage unit to the tip discharge opening, moving the plunger in a direction of retraction from inside the intermediate liquid passage while the storage-side valve is in a communicating state and the discharge-side valve is interrupted, and subsequently moving the plunger in a direction of protrusion into the intermediate liquid passage while the storage-side valve is interrupted and the discharge-side valve is in a communicating state.

The application head may be capable of slightly moving the liquid at the tip discharge opening in a suction direction by slightly moving the plunger in the direction of retraction from inside the intermediate liquid passage after the discharge operation.

Both the storage-side valve and the discharge-side valve may be capable of being in a communicating state during the same period.

The application head may be capable of continuous application by moving and applying a discharge pressure to the liquid in the liquid storage unit while both the storage-side valve and the discharge-side valve are in a communicating state.

The application head may be capable of slightly moving the liquid at the tip discharge opening in a suction direction by slightly moving the plunger in a direction of retraction from inside the intermediate liquid passage after release of the discharge pressure in the continuous application.

The application head may be capable of completing an air removal operation achieving a state in which the liquid passage from the liquid storage unit to the tip discharge opening is filled with the liquid by reciprocating the plunger a plurality of times while both the storage-side valve and the discharge-side valve are in a communicating state.

When both the storage-side valve and the discharge-side valve are in a communicating state, a straight line may be formed downward by the liquid passage from the liquid storage unit to the tip discharge opening.

The application head may include a first actuator independently driving each of the storage-side valve and the discharge-side valve. Each of the storage-side valve and the discharge-side valve may have a first fitting portion. The first actuator may operate a second fitting portion engaged with each of the first fitting portions with a driving unit to operate each of the storage-side valve and the discharge-side valve. The first fitting portion and the second fitting portion may be attachable to and detachable from each other.

The first fitting portion may be attachable to and detachable from the second fitting portion from direction of an operator.

The first fitting portion may be a rectangular fitting convex portion. The second fitting portion may be a fitting groove. At the time of the attachment/detachment, the fitting convex portion may be capable of being pulled out in the horizontal direction when the fitting groove is oriented in the substantially horizontal direction.

When the fitting convex portion is capable of being pulled out in the substantially horizontal direction, the discharge-side valve may be closed.

The fitting convex portions may be rounded at four corners viewed from the axial direction of the storage-side valve and the discharge-side valve.

The application head may include a second actuator advancing and retracting the plunger relative to the intermediate liquid passage. The plunger may be clamped by a clamp to be fixed to a movable portion of the second actuator. The plunger may be capable of being separated from the second actuator when the clamp is loosened and retreated.

The plunger may be attachable to and detachable from the second actuator from direction of an operator.

The application head may include: a block having a liquid passage between the liquid storage unit and the tip discharge opening as a through-hole and having two bush insertion holes formed to cross the through-hole; and a storage-side bush and a discharge-side bush having the storage-side valve and the discharge-side valve respectively inserted rotatably within a predetermined angle range. The storage-side bush and the discharge-side bush may be each provided with a through hole formed on a side surface to make up a portion of the liquid passage, and may be respectively inserted into the two bush insertion holes.

Adhesive may be applied between each of the storage-side and discharge-side bushes and each of the two bush insertion holes without a gap.

The application head may include a liquid pool on a lower portion of the block for receiving liquid when the liquid seeps out from a slight gap between each of the storage-side and discharge-side bushes and each of the storage-side and discharge-side valves.

The storage-side and discharge-side bushes and the storage-side and discharge-side valves may be made of silicon carbide.

The application head may include: first seal members surrounding or covering a gap between the storage-side bush and the storage-side valve and a gap between the discharge-side bush and the discharge-side valve, respectively, on at least one end side of each of the storage-side bush and the discharge-side bush; and a pressing plate attached to the block to press the first seal members.

Each of the storage-side valve and the discharge-side valve may include flange part. The application head may include second seal members sandwiched between the flange part of the storage-side valve and an end part of the storage-side bush or a surface of the block and between the flange part of the discharge-side valve and an end part of the discharge-side bush or a surface of the block.

The second seal members may be lubricating.

The application head may include pressing member which elastically press end parts of the flange part side of the storage-side valve and the discharge-side valve, respectively.

In another aspect of the present invention, a droplet application apparatus include: at least one application head; and a means of moving the application head relative to an object to be coated in XYZ directions that are three directions different from each other. The application head include: a liquid storage unit storing liquid and having a predetermined pressure applied to the inside; a tip discharge opening discharging a droplet; a liquid passage from the liquid storage unit to the tip discharge opening; a storage-side valve inserted into the liquid passage; a discharge-side valve inserted in the liquid passage on the downstream side relative to the storage-side valve; and a plunger sliding in a space in communication with an intermediate liquid passage that is a liquid passage between the storage-side valve and the discharge-side valve to change a volume of liquid in the intermediate liquid passage. Each of the storage-side valve and the discharge-side valve has a column-shaped part, is provided with a through-hole penetrating between outer circumferential surfaces of the column-shaped part, and is rotatable at least within a predetermined angle range around a center axis of the column-shaped part. The through-holes of the storage-side valve and the discharge-side valve each communicates with the liquid passage on both sides at a predetermined rotational position and does not communicate with the liquid passage on both sides at the other rotational positions.

It is to be noted that any arbitrary combination of the above-described structural components as well as the expressions according to the present invention changed among a system and so forth are all effective as and encompassed by the present aspects.

According to the aspects described above,

BRIEF DESCRIPTION OF THE DRAWINGS

Embodiments will now be described, by way of example only, with reference to the accompanying drawings which are meant to be exemplary, not limiting, and wherein like elements are numbered alike in several Figures, the drawings in which.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

First Embodiment

Figure 1:
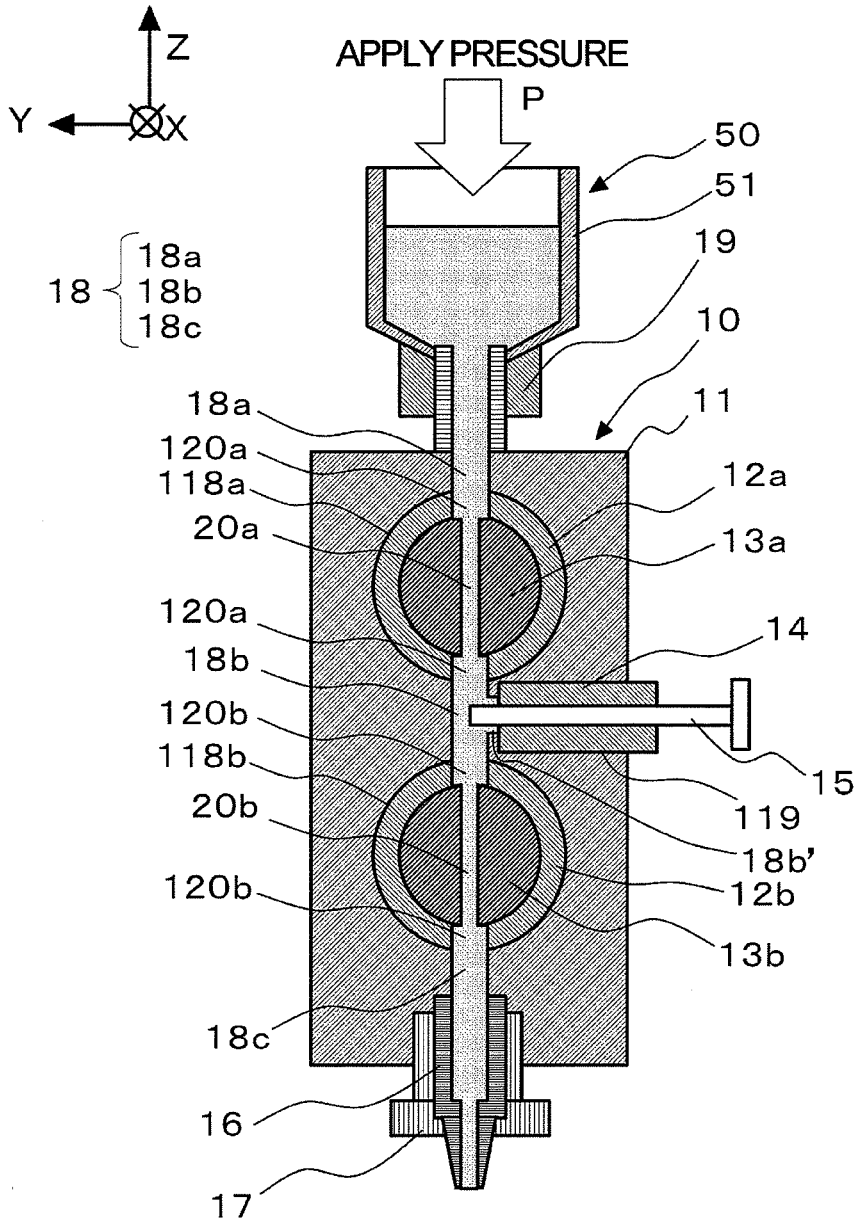
FIG. 1 is a front cross-sectional view showing a general configuration of a main portion of an application head according to a first embodiment of the present invention.
Figure 2A:
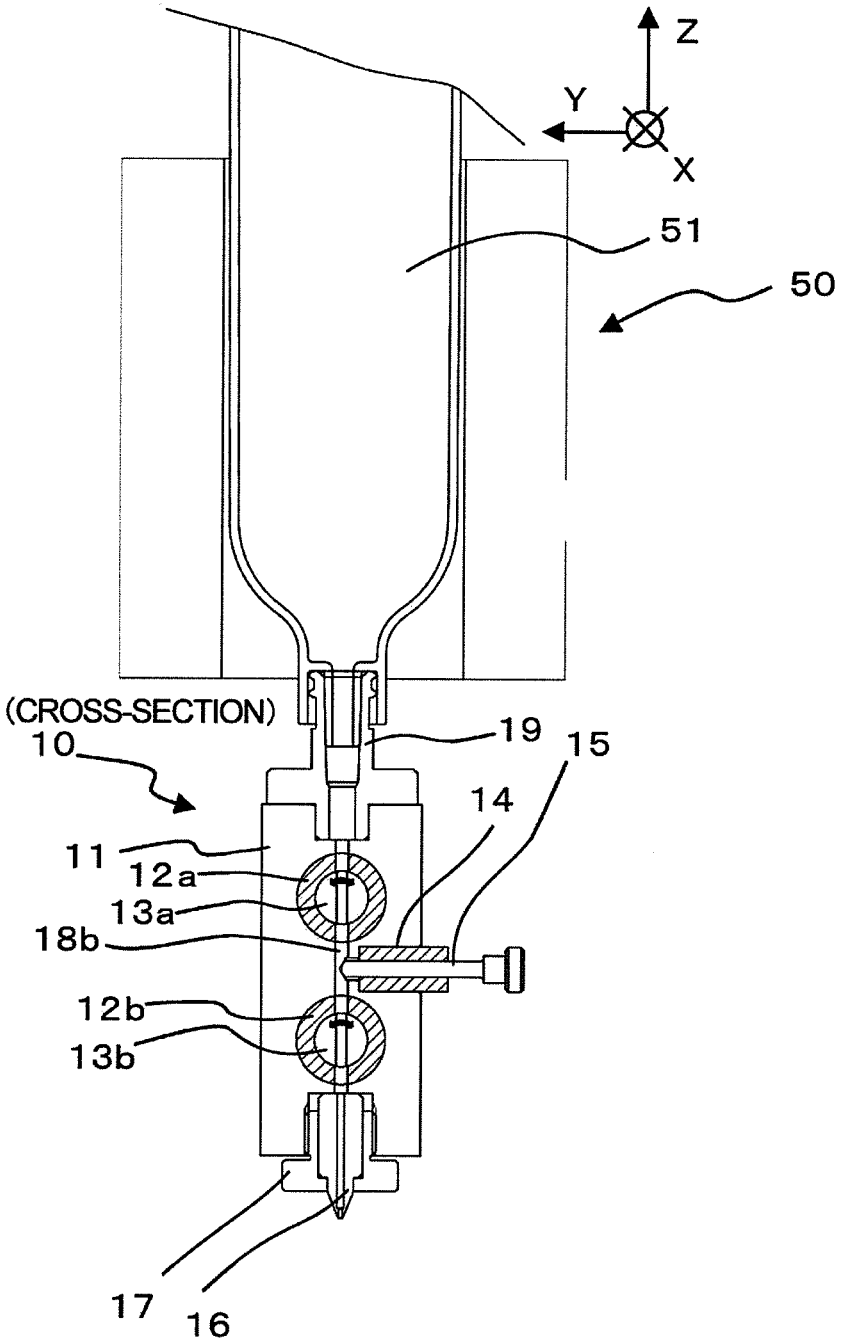
FIG. 2A is a front cross-sectional view of a specific configuration of the main portion of the application head.
Figure 2B:
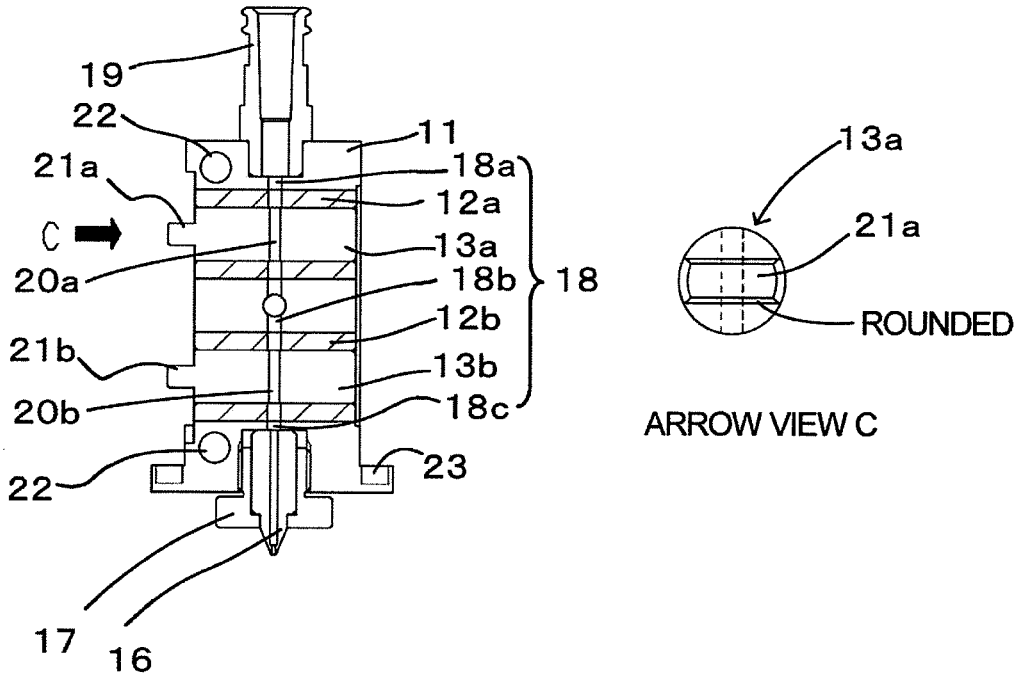
FIG. 2B is a partial right-side cross-sectional view thereof.
Figure 3:
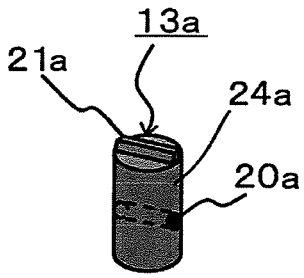
FIG. 3 is a perspective view of a storage-side valve used in the application head.
Figure 4:
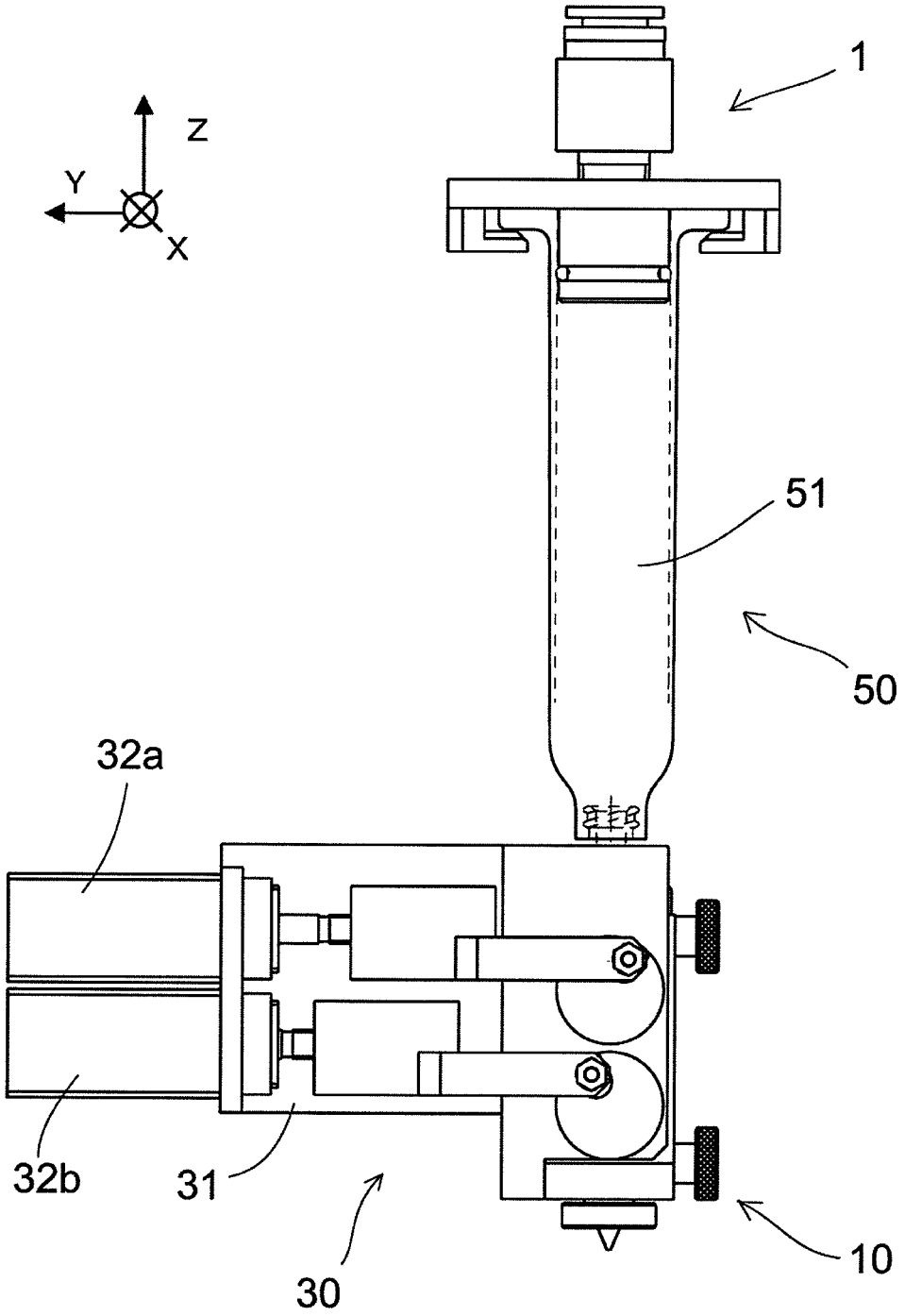
FIG. 4 is a front cross-sectional view of an overall configuration of the application head.

FIG. 1 is a front cross-sectional view of a general configuration of a main portion of an application head 1 according to a first embodiment of the present invention. FIG. 2A and FIG. 2B are cross-sectional views of a specific configuration of the main portion of the application head 1 and FIG. 2A is a front cross-sectional view while FIG. 2B is a partial right-side cross-sectional view. FIG. 3 is a perspective view of a storage-side valve 13*a* used in the application head 1. A discharge-side valve 13*b* has the same shape as the storage-side valve 13*a* shown in FIG. 3. FIG. 4 is a front cross-sectional view of an overall configuration of the application head 1. A coordinate system of the figures defines the X-axis and Y-axis orthogonal to each other on a horizontal plane and the Z-axis in the vertical direction. The Y-minus direction is defined as the direction toward an operator in the figures. However, a configuration in the embodiment is not limited to this coordinate system and the Z-axis may be tilted from the vertical direction, for example.

As shown in FIG. 4, the application head 1 is mainly made up of the following three elements:

a discharging unit 10;

a driving unit 30; and a storage unit 50.

The storage unit 50 (liquid storage unit) has a role of storing liquid to be discharged and, as shown in FIG. 2, the liquid is injected into a substantially sealed tank 51 (syringe) and predetermined pressure air (pressure medium) is applied to the space inside the tank 51 to continuously send the liquid in the tank 51 to a joint 19 of the discharging unit 10 at a predetermined pressure. This configuration is used and known in conventional droplet applying apparatuses. The discharging unit 10 is supplied with the liquid via the joint 19 from the storage unit 50 to apply a droplet from a tip discharge opening of a nozzle 16 to an object to be coated. The driving unit 30 is drives constituent elements of the discharging unit 10. A fitting unit and a clamp are utilized for power transmission from the driving unit 30 to the discharging unit 10. Details of configurations and operations of the discharging unit 10 and the driving unit 30 will be described later.

(Configuration of Discharging Unit 10) As shown in FIG. 1 and FIG. 2, the discharging unit 10 has the joint 19, a block 11, a storage-side bush 12*a*, a discharge-side bush 12*b*, a storage-side valve 13*a*, a discharge-side valve 13*b*, a plunger 15, and a nozzle 16. The joint 19 is fixed to a top surface of the block 11 by screws etc. To the joint 19, a tip portion (lower end portion) of the tank 51 is for example screwed. The nozzle 16 has a tip portion in a cone shape, for example, and is fixed to an under surface of the block 11 by a lock nut 17.

The block 11 has a liquid passage 18 between the joint 19 and the nozzle 16 in communication with the storage unit 50 in the Z-direction as a through-hole in the Z-direction. The storage-side valve 13*a* is inserted into the liquid passage 18. The discharge-side valve 13*b* is inserted into the liquid passage 18 on the downstream side (closer to the nozzle 16) relative to the storage-side valve 13*a*. Specifically, the block 11 has two bush insertion holes 118*a* and 118*b* (FIG. 1) that are through-holes formed to cross the liquid passage 18 perpendicularly (in the X-direction), for example, and that have cylindrical surfaces as inner surfaces. The storage-side bush 12*a* and the discharge-side bush 12*b* in, for example, a cylindrical shape are inserted into the bush insertion holes 118*a* and 118*b*, respectively. The storage-side valve 13*a* and the discharge-side valve 13*b* are inserted into the storage-side bush 12*a* and the discharge-side bush 12*b*, respectively, in a rotatable manner (rotatably within a predetermined angle range). The storage-side valve 13*a* and the discharge-side valve 13*b* are made of a material such as silicon carbide, for example. A liquid passage closer to the tank 51, a liquid passage between the storage-side valve 13*a* and the discharge-side valve 13*b*, and a liquid passage closer to the nozzle 16 will hereinafter distinctly be described as a storage-side liquid passage 18*a*, an intermediate liquid passage 18*b*, and a discharge-side liquid passage 18*c*, respectively, as needed. The intermediate liquid passage 18*b* refers to an entire space in which liquid may be present between the storage-side valve 13*a* and the discharge-side valve 13*b*, is not limited to a passage consisting only of a linear portion, and may include a reciprocation range of the plunger 15 and a partially laterally protruding portion 18*b*' in the vicinity thereof (FIG. 1).

Adhesive is applied between the storage-side bush 12*a* and the bush insertion hole 118*a* and between the discharge-side bush 12*b* and the bush insertion hole 118*b* without a gap to adhesively fix the storage-side bush 12*a* and the discharge-side bush 12*b* to the block 11. In this state, a pair of through-holes 120*a* and 120*b* (FIG. 1) respectively formed on the outer circumferential surfaces of the storage-side bush 12*a* and the discharge-side bush 12*b* communicate with the through-hole (through-hole making up the liquid passage 18) of the block 11 to form a portion of the liquid passage 18. The storage-side bush 12*a* and the discharge-side bush 12*b* have a function of bearing for the rotary movement of the storage-side valve 13*a* and the discharge-side valve 13*b* and are made of a material such as silicon carbide, for example.

As shown in FIG. 3, the storage-side valve 13*a* has a column-shaped unit 24*a* inserted into the storage-side bush 12*a*, is provided with a through-hole 20*a* penetrating between outer circumferential surfaces of the column-shaped unit 24*a*, and is rotatable at least within a predetermined angle range around a rotation axis that is a center axis of the column-shaped unit 24*a*. The through-hole 20*a* perpendicularly crosses the center axis of the column-shaped unit 24*a*, for example. At a predetermined rotational position, the through-hole 20*a* is in the Z-direction and communicates with the liquid passages on the both sides of the through-hole 20*a* (the storage-side liquid passage 18*a* and the intermediate liquid passage 18*b*) via the through-hole 120*a* of the storage-side bush 12*a*. At the other rotational positions, the through-hole 20*a* is in the directions different from the Z-direction and does not communicate with the liquid passages on the both sides of the through-hole 20*a* (a section between the both liquid passages are interrupted). Therefore, the storage-side valve 13*a* acts as a valve communicating and interrupting the liquid passage 18 from the joint 19 to the nozzle 16 depending on a rotational position thereof. A fitting convex portion 21*a* in a convex shape is radially disposed on one end surface of the column-shaped unit 24*a*. The fitting convex portion 21*a* (protruding portion) is a fitting portion for an actuator driving the storage-side valve 13*a* and the function thereof will be described later. The discharge-side valve 13*b* has the same shape as the storage-side valve 13*a* and acts as a valve communicating and interrupting the liquid passage 18 from the joint 19 to the nozzle 16 depending on a rotational position thereof as is the case with the storage-side valve 13*a*. If both the storage-side valve 13*a* and the discharge-side valve 13*b* are allowed to communicate (i.e., the through-holes 20*a* and 20*b* of the both valves are turned to the Z-direction), the liquid passage of the discharging unit 10 is configured to form a straight line in the Z-minus direction (downward in general) from the tank 51 to the nozzle 16.

The plunger 15 is disposed in the block 11 in a manner enabling projection toward the intermediate liquid passage 18*b* that is a liquid passage between the storage-side valve 13*a* and the discharge-side valve 13*b* and changes a volume of the liquid within the intermediate liquid passage 18*b* depending on a change in a projection state. Specifically, the block 11 has a bush insertion hole 119 (FIG. 1). The bush insertion hole 119 is, for example, perpendicular to the intermediate liquid passage 18*b*, communicates with the intermediate liquid passage 18*b* laterally (in Y direction), and has a cylindrical surface as an inner surface. A plunger bush 14 in, for example, a cylindrical shape is inserted into the bush insertion hole 119. The plunger 15 is inserted into the plunger bush 14 and is slidable in the axial direction. The plunger bush 14 has a function of bearing for the linear movement of the plunger 15 and is made of a material such as silicon carbide, for example. The plunger 15 is reciprocated between a standby position and a projected position by the driving unit 30 described later. Although the direction of the axis of the plunger 15 is not limited, the plunger 15 is preferably disposed to be pulled out toward an operator, i.e., in the Y-minus direction in consideration of maintenance property described later.

To realize highly-accurate and repeatable discharge, the application head 1 of the embodiment discharges liquid in accordance with a minute volume change of liquid in the intermediate liquid passage 18*b* due to the reciprocation of the plunger 15 as described later. Therefore, the liquid passage 18, the storage-side valve 13*a*, and the discharge-side valve 13*b* are required to have a structure that leaves no air bubble and that causes no elastic deformation of a seal material.

Therefore, for example, a sufficient amount of adhesive is utilized and applied for assembly between the bush insertion holes 118*a*, 118*b* (FIG. 1) of the block 11 and the storage-side and discharge-side bushes 12*a*, 12*b* so as not to generate a gap. A seal member used between movable objects is not used between the through-holes 120*a*, 120*b* of the storage-side and discharge-side bushes 12*a*, 12*b* and the storage-side and the discharge-side valves 13*a*, 13*b*. The use of the seal member poses a problem that a conduit line capacity is changed in a conduit line made up of the liquid passage 18, the through-holes 120*a*, 120*b* of the storage-side bush 12*a* and the discharge-side bush 12*b*, the storage-side valve 13*a*, and the discharge-side valve 13*b*. The use of the seal member also makes removable of air very difficult depending on a disposition location of the seal member.

Although the absence of use of the seal member leads to a very slight leak of liquid from between the storage-side bush 12*a* and the storage-side valve 13*a* and between the discharge-side bush 12*b* and the discharge-side valve 13*b*, the leak is limited to the extent that liquid seeps out after several tens of thousands of shots of discharge operations and, in terms of discharge amount data, it can be said that the leak itself has no substantial adverse effect on a minute volume change due to the reciprocation of the plunger 15. However, to prevent the seeping liquid from travelling on an outer wall of the block 11 and dropping on an object to be coated, a liquid pool 23 is included in a lower portion of the block 11 (FIG. 2B).

(Discharge Operation) FIG. 5A to FIG. 5D are explanatory views of a discharge operation by the application head 1. The discharge operation of the discharging unit 10 having the configuration described above will be explained with reference to FIG. 5A to FIG. 5D. First, an air removal operation is performed to achieve an initial state in which the liquid passage from the tank 51 to the tip discharge opening of the nozzle 16 (the through-hole of the joint 19, the liquid passages 18*a*, 18*b*, and 18*c* formed as through-holes in the block 11, the through-holes 20*a*, 20*b* of the storage-side valve 13*a* and the discharge-side valve 13*b*, the through-holes 120*a*, 120*b* of the storage-side bush 12*a* and the discharge-side bush 12*b*, and the through-hole of the nozzle 16) is filled with liquid without air (air bubble).

Figures 5A, 5B, 5C, 5D:
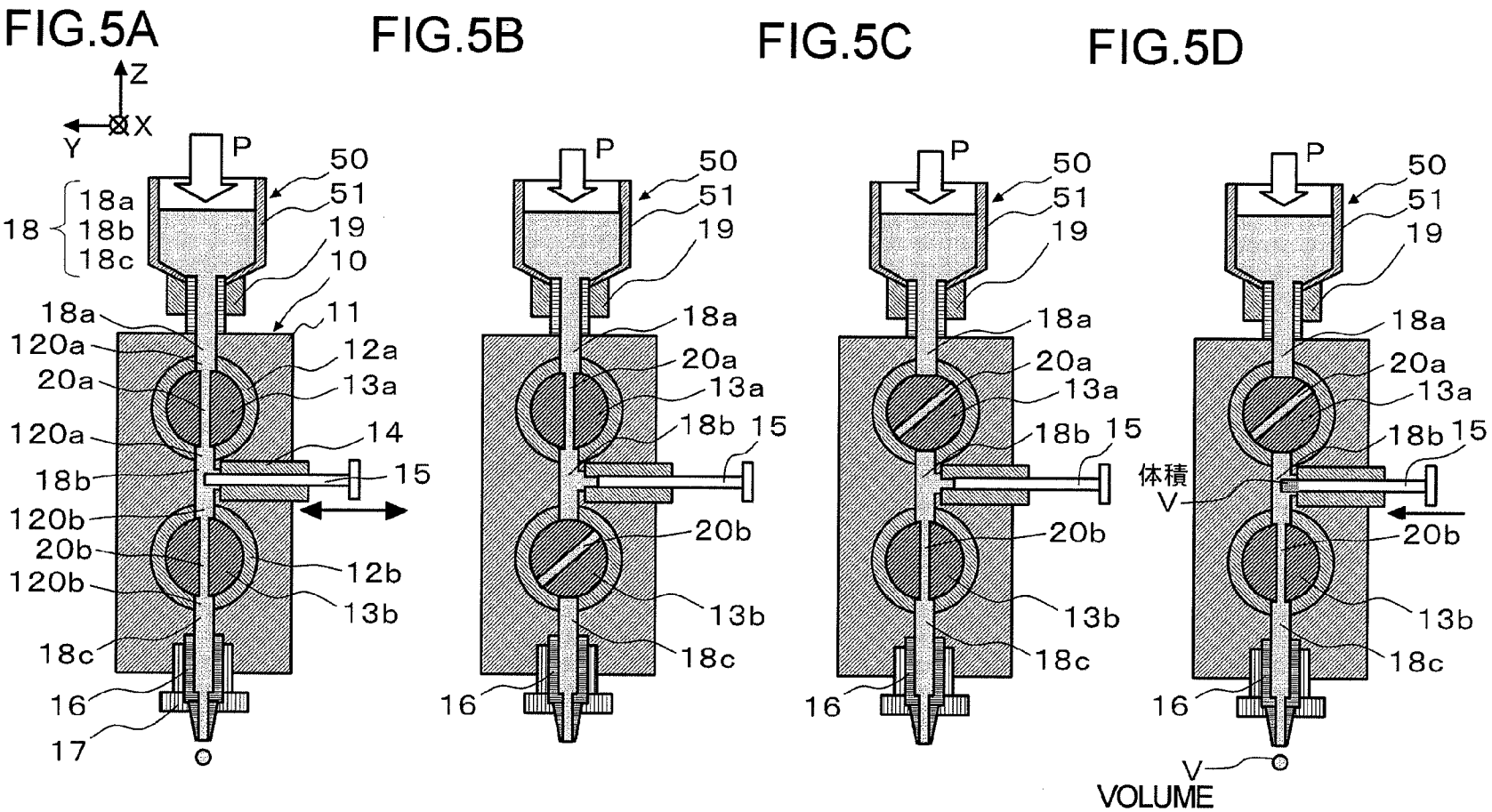
FIG. 5A to FIG. 5D are explanatory views of a discharge operation by the application head.

Specifically, since the tank 51 of the storage unit 50 is in communication via the joint 19 with the liquid passage 18 in the block 11 of the discharging unit 10, as shown in FIG. 5A, both the storage-side valve 13*a* and the discharge-side valve 13*b* are positioned to be in communication with the liquid passage 18 and, while a predetermined pressure P is applied to a liquid surface of the liquid to be discharged in the tank 51, the plunger 15 is reciprocated a plurality of times between the standby position and the protruded position to complete the air removal (if an air bubble is present, the air bubble is discharged from the tip discharge opening of the nozzle 16).

After the completion of the air removable, the discharge operation is performed. As is the case with the time of air removal, the liquid to be discharged is stored in the tank 51 of the storage unit 50 and the predetermined pressure P is applied to the liquid surface. The tank 51 is in communication via the joint 19 with the liquid passage 18 in the block 11 of the discharging unit 10. In this state, first, as shown in FIG. 5B, the through-hole 20*a* of the storage-side valve 13*a* is set to the position in communication with the storage-side liquid passage 18*a* and the intermediate liquid passage 18*b* while the through-hole 20*b* of the discharge-side valve 13*b* is tilted relative to the Z-direction (rotated around the axis of the column-shaped part of the discharge-side valve 13*b* by a predetermined angle) to interrupt the liquid passage between the intermediate liquid passage 18*b* and the discharge-side liquid passage 18*c*. As a result, the tank 51, the storage-side liquid passage 18*a*, the through-hole 20*a*, and the intermediate liquid passage 18*b* are in communication with each other and filled with the pressure P. At this point, the plunger 15 is located on the standby side (in the Y-minus side).

As shown in FIG. 5C, the storage-side valve 13*a* and the discharge-side valve 13*b* are then rotated by a predetermined angle such that the storage-side valve 13*a* interrupts the liquid passage between the storage-side liquid passage 18*a* and the intermediate liquid passage 18*b* while the through-hole 20*b* of the discharge-side valve 13*b* is set to a position in communication with the intermediate liquid passage 18*b* and the discharge-side liquid passage 18*c*. In this case, the interruption by the storage-side valve 13*a* may be achieved earlier than the communication of the discharge-side valve 13*b*. As a result, while the intermediate liquid passage 18*b*, the through-hole 20*b*, and the discharge-side liquid passage 18*c* are in communication with each other, the tank 51 is interrupted by the storage-side valve 13*a* and, therefore, the pressure P applied to the liquid surface in the tank 51 does not act on the downstream from the storage-side valve 13*a*.

As shown in FIG. 5D, while the storage-side valve 13*a* and the discharge-side valve 13*b* are maintained in the state of FIG. 5C, the plunger 15 is then moved from the standby position to the protruded position. As a result, the liquid is moved from the intermediate liquid passage 18*b* through the through-hole 20*b* and the discharge-side liquid passage 18*c* to the nozzle 16 by a volume V of the plunger 15 protruded into the intermediate liquid passage 18*b*, and a droplet is finally discharged from the tip discharge opening of the nozzle 16 by the volume V. After the discharge, the plunger 15 is returned to the standby position by a minute amount to slightly move the liquid at the tip discharge opening of the nozzle 16 in the suction direction, thereby producing an effect of preventing the liquid from attaching to a tip outer portion of the nozzle 16 (suck back function).

The operations described with reference to FIG. 5B to FIG. 5D are sequentially executed in a continuous manner to enable discharge of a stable amount (volume) of droplet. Specifically, the following capabilities are achieved, which are suitable for an LED-phosphor potting application:

discharge amount of 0.0002 ml to 0.1 ml;
discharge accuracy of 0.5% (3σ) or less;
viscosity of 100 to 50000 mPa·s; and
processing capacity of 0.6 sec or less per shot.

(Continuous Application) The application head 1 can perform a continuous application operation as a compressed air type dispenser in addition to the discharge operation using the reciprocation of the plunger 15. Although not shown, the storage unit 50 is connected via piping to a valve and a compressed air source and, in the state of FIG. 1, i.e., while both the storage-side valve 13*a* and the discharge-side valve 13*b* are in communication with the liquid passage 18 after the completion of the air removal, the tip of the nozzle 16 is brought closer to an object to be coated and a discharge pressure (larger than the predetermined pressure P at the time of discharge using the reciprocation of the plunger 15) is applied to the liquid in the storage unit 50 while the application head 1 is moved in the XY-direction, thereby enabling the continuous application as in the case of the compressed air type dispenser. After the continuous application is performed with the plunger 15 protruded into the intermediate liquid passage 18*b*, the plunger 15 is returned to the standby position by a minute amount at the timing of release of the discharge pressure (return to the predetermined pressure P) to slightly move the liquid at the tip discharge opening of the nozzle 16 in the suction direction, thereby producing the effect of preventing the liquid from attaching to the tip outer portion of the nozzle 16 (suck back function). Although a negative pressure can be applied to the liquid in the storage unit 50 to suck back the liquid at the tip discharge opening of the nozzle 16, the suck-back by retraction of the plunger 15 has an advantage of quick response because the suck-back is performed at a position closer to the nozzle 16.

Figure 6:
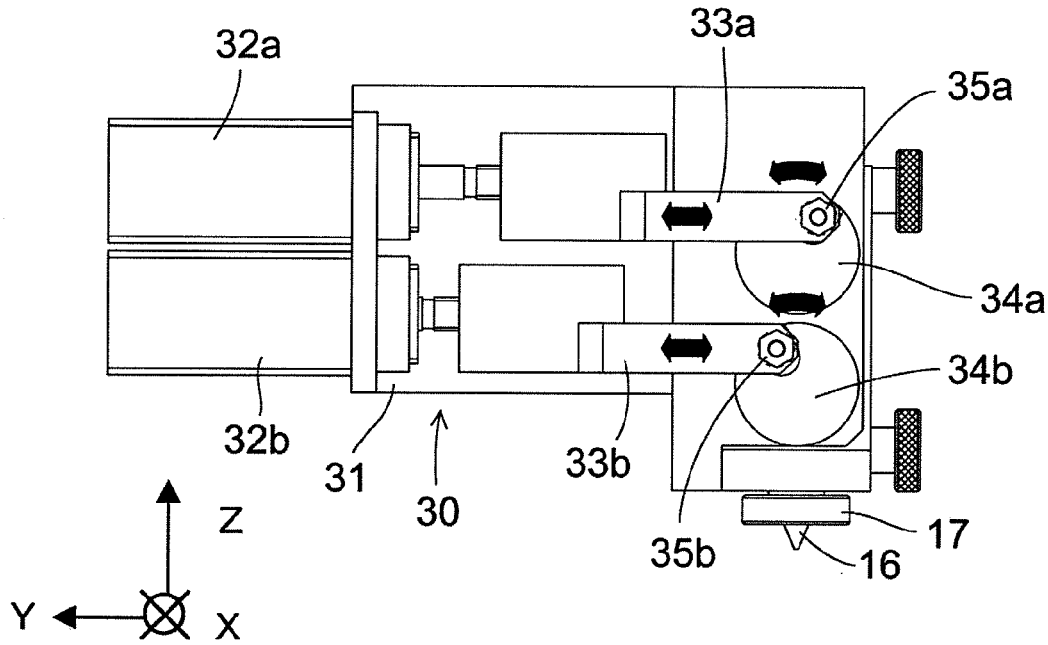
FIG. 6 is an enlarged view of a portion of FIG. 4 for explaining a configuration of valve drive.
Figure 7A:
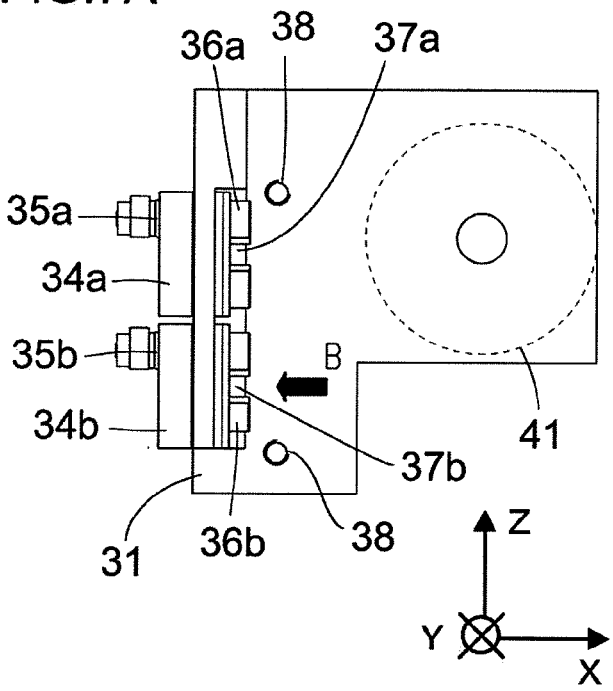
FIG. 7A is a right side view of the configuration shown in FIG. 6.
Figure 7B:
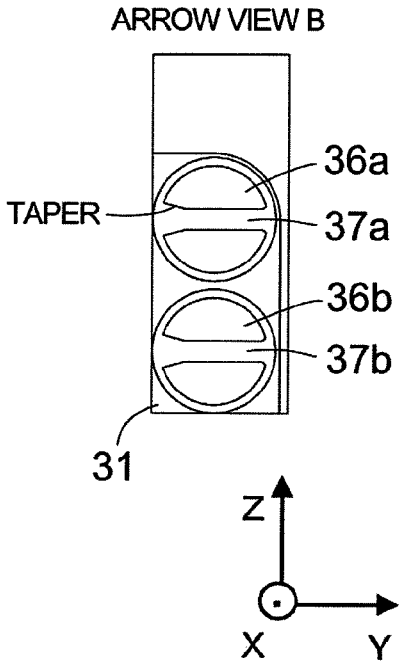
FIG. 7B is an arrow view of FIG. 7A along an arrow B.
Figure 8:
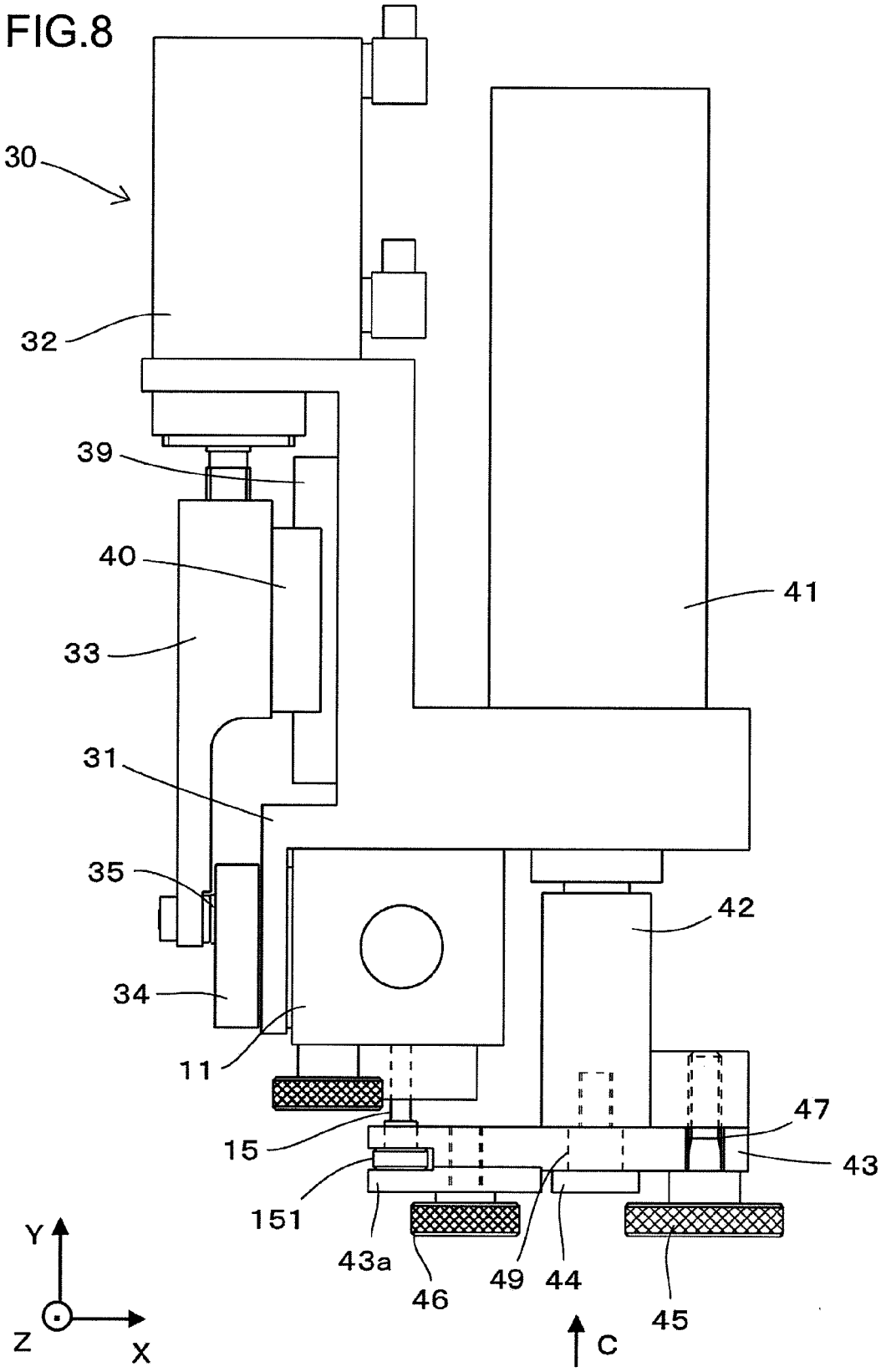
FIG. 8 is a plain view of the application head.
Figure 9A:
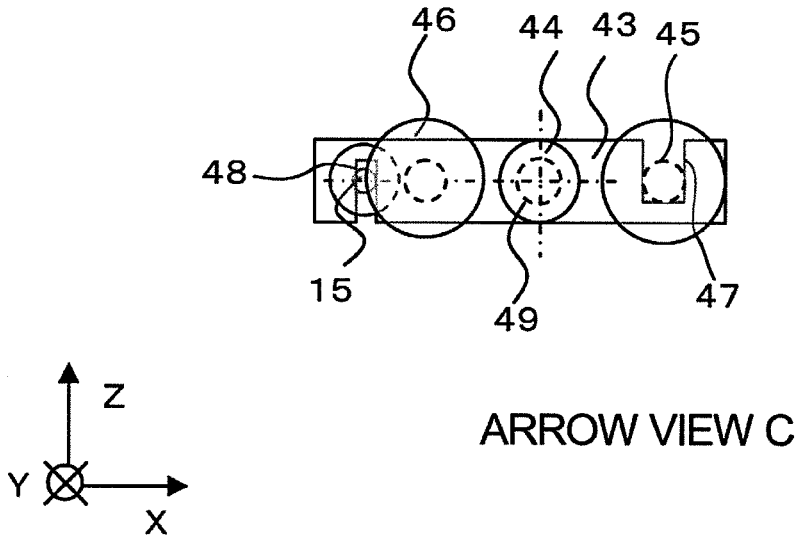
FIG. 9A is an arrow view of a portion of FIG. 8 along an arrow C with a plunger fixed state.
Figure 9B:
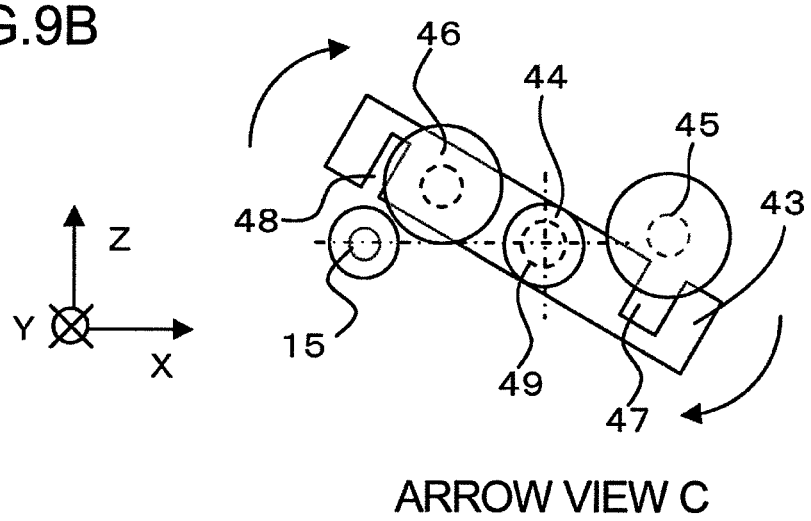
FIG. 9B is an arrow view thereof with the plunger released state.

(Configuration of Driving Unit 30) A configuration of the driving unit 30 for performing the discharge operation including the air removal will be described with reference to FIG. 6 to FIG. 9B. FIG. 6 is an enlarged view of a portion of FIG. 4 for explaining a configuration of valve drive. FIG. 7A is a side view of the configuration shown in FIG. 6 viewed from the right side. FIG. 7B is an arrow view of FIG. 7A along an arrow B. FIG. 8 is a plain view of the application head 1. FIG. 9A and FIG. 9B are arrow views of a portion of FIG. 8 along an arrow C and FIG. 9A shows a plunger fixed state while FIG. 9B shows a plunger released state. However, a pressing plate 43*a* shown in FIG. 8 is transparent in FIG. 9.

As shown in FIG. 8, the driving unit 30 is formed by attaching a valve drive actuator 32 and a plunger drive actuator 41 to a bracket 31 fixed to a Z-axis slider 325 described later with reference to FIG. 10. As shown in FIG. 6, the valve drive actuator 32 includes an actuator 32*a* driving the storage-side valve 13*a* and an actuator 32*b* driving the discharge-side valve 13*b* and, although operating independently of each other, the both actuators have the same configuration. Therefore, the both actuators are collectively referred to as the valve drive actuator 32 in the following description. In FIG. 6 and FIG. 7, "a" is added to reference numerals of constituent elements related to the drive of the storage-side valve 13*a* and "b" is added to reference numerals of constituent elements related to the drive of the discharge-side valve 13*b*.

A main body (a power source such as an air cylinder) of the valve drive actuator 32 is attached to the bracket 31 and a rod 33 (33*a*, 33*b*) is attached to the bracket 31 via a guide 40 and a guide rail 39 (FIG. 8) in a linearly movable manner on the moving side of the valve drive actuator 32. A roller 35 (35*a*, 35*b*) is fixed to an end portion of the rod 33. A shaft 34 (34*a*, 34*b*) is attached to the bracket 31 via a bearing not shown in a rotatable manner. A groove is machined on an end surface of the shaft 34 and engaged with the roller 35. Since the central axis of the shaft 34 is offset from the position of the roller 35, a linear movement operation of the valve drive actuator 32 is converted via the rod 33 and the roller 35 into rotary motion of the shaft 34. The rotary motion may be caused by connection through a link from the valve drive actuator or, if the actuator rotates as in the case of a motor, the shaft 34 may be rotated with a timing belt etc. A mechanism realizing the rotary motion of the shaft 34 is not limited to this description.

As shown in FIG. 7, a flange 36 (36*a*, 36*b*) with a fitting groove 37 (37*a*, 37*b*) machined is located on the opposite side of the shaft 34 across the bearing. The movement of the valve drive actuator 32 is converted into the rotary motion of the shaft 34 to enable the rotary motion of the flange 36 and the fitting groove 37. The fitting groove 37 (37*a*, 37*b*) is fitted to each of the fitting convex portions 21*a* and 21*b* (FIG. 3) of the storage-side valve 13*a* and the discharge-side valve 13*b* so that the valve drive actuator 32 (32*a*, 32*b*) can rotate the storage-side valve 13*a* and the discharge-side valve 13*b*. The flange 36 has a larger diameter such that the fitting groove 37 is made longer than the fitting convex portions 21*a* and 21*b* of the storage-side valve 13*a* and the discharge-side valve 13*b* so as to facilitate the insertion of the fitting convex portions 21*a* and 21*b*. The fitting groove 37 may be tapered for the same reason.

In this case, the fitting convex portions 21*a* and 21*b* are preferably rounded at four corners viewed from the axial direction of the valves 13*a* and 13*b* (arrow view C of FIG. 2) to prevent damage from impact due to the operation of the actuator 32.

Although the valve drive actuator 32 of the embodiment uses an air cylinder as a power source for linear movement, this is not a limitation and, for example, a solenoid may be used. The drive force transmission through engagement between the fitting groove 37 and the fitting convex portion of each of the valves is not limited to this description and the groove and the convex portion may inversely be arranged or easily detachable transmission elements such as gears may be used.

As shown in FIG. 8, a main body (e.g., a power source having a ball screw and a servo motor) of the plunger drive actuator 41 is attached to the bracket 31. A block 42 is attached to the moving side of the plunger drive actuator 41 in a linearly movable manner. A plate 43 is attached to the block 42. As shown in FIG. 9, the plate 43 has a hole 49 fitted to a fulcrum shaft 44 attached to the block 42 and a cutout 47 allowing penetration of an attachment male screw 45 fastening the plate 43 in combination with a female screw of the block 42. The loosening of the attachment male screw 45 enables the rotary movement of the plate 43 using the fulcrum shaft 44 as a fulcrum.

As shown in FIG. 8, the pressing plate 43*a* is fastened by a clamp male screw 46 at the leading end of the plate 43 and this fastening force clamps a flange portion 151 of the plunger 15 along with the plate 43 to transmit the operation of the plunger drive actuator 41. The plate 43 also has a cutout 48 (FIG. 9) for avoiding the plunger to enable the rotary motion. The plunger drive actuator 41 of the embodiment can provide accurate discharge control because of use of a direct acting type actuator capable of multipoint position control.

The application heads 1 of the embodiment can sequentially be arranged in the droplet applying apparatus and an arrangement pitch thereof is less than 60 mm.

(Disassembly) The combination of the discharging unit 10 and the driving unit 30 is disassembled in the following procedure. The driving unit 30 having the valve drive actuator 32, the plunger drive actuator 41, and other transmission components attached and the storage unit 50 are fixed to the apparatus main body side. The storage unit 50 can easily be detached from the joint 19 of the discharging unit 10 by loosening the attachment of the tank 51 of the storage unit 50 and pulling up the storage unit 50 in the Z-plus direction.

An operation of separating the plunger drive actuator 41 from the plunger 15 will then be described. First, the clamp male screw 46 of the plate 43 is loosened to release the fastening of the plunger 15 and the plate 43. After the attachment male screw 45 is then loosened to release the fastening of the plate 43 and the block 42, the plate 43 is rotated around the fulcrum shaft 44 and the plunger 15 is self-supported and released from the plate 43 while being inserted in the hole of the plunger bush 14. In this state, the plunger 15 can easily be pulled out from the hole of the plunger bush 14.

To separate the valve drive actuator 32 from the storage-side valve 13*a* and the discharge-side valve 13*b*, first, the fitting convex portions 21*a* and 21*b* (FIG. 2B and FIG. 3) of the storage-side valve 13*a* and the discharge-side valve 13*b* are positioned substantially in parallel with the Y-axis (controlled through apparatus control). An angle between the fitting convex portion 21*b* and the through-hole 20*b* is set so that the discharge-side valve 13*b* is closed in this state. Since the driving unit 30 and the discharging unit 10 are fixed by fastening attachment holes 22 (FIG. 2B) of the block 11 and attachment female screws 38 (FIG. 7A) of the bracket 31 with male screws not shown, the male screws are loosened and removed. Since the tank 51 is separated from the block 11, the block 11 is directly pulled out toward an operator (in the Y-minus direction) and completely separated. The assembly may be performed by following the procedure in reverse.

Figure 10:
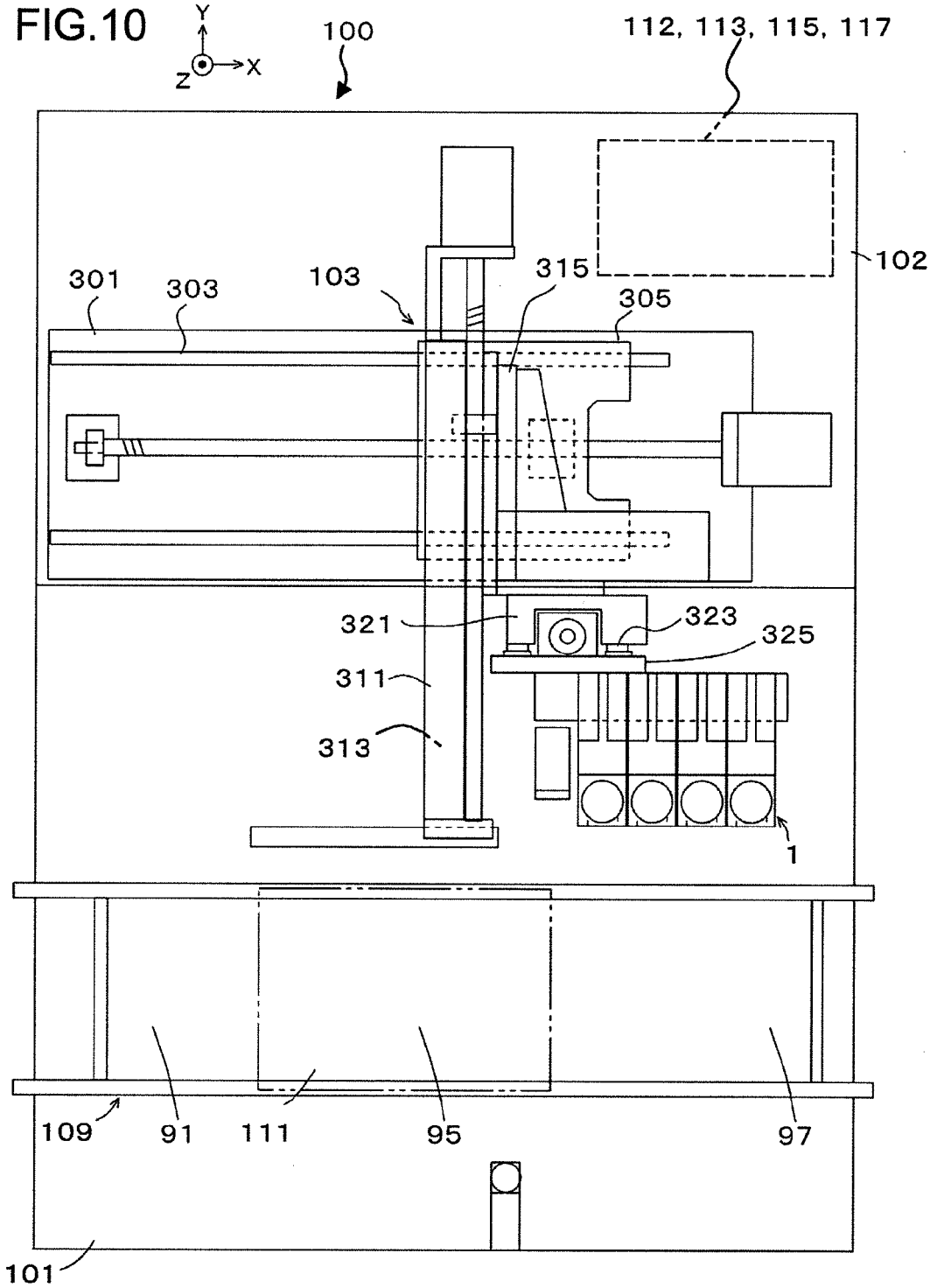
FIG. 10 is a plain view of a droplet applying apparatus according to the first embodiment of the present invention.

(General Description of Apparatus) FIG. 10 is a plain view of a droplet applying apparatus 100 according to the first embodiment of the present invention. The droplet applying apparatus 100 includes a base 101, a placing pedestal 101, an XYZ table 103, application heads 1 (four application heads in this case) having the configuration above described, a carrying unit 109, and a main control unit 112. Two orthogonal directions in a horizontal plane are defined as X- and Y-directions and a vertical direction is defined as Z-direction.

The placing pedestal 102 is fixed to a top surface of the base 101 while the XYZ table 103 is fixed to the placing pedestal 102, and the application heads 1 are supported by the XYZ table 103 to be movable in each of the XYZ-directions. The carrying unit 109 is fixed to the top surface of the base 101 and the carrying unit 109 carries a substrate 111, i.e., an object to be coated, in the X-direction. The object to be coated may be a substrate such as a semiconductor packaging substrate as well as an LCD (Liquid Crystal Display) panel, a LED (Light-Emitting Diode), etc. The main control unit 112 is located inside the base 101 (housing) to control the operation of the whole apparatus including the application heads 1 and has a storage unit 113, a calculating unit 115, and a pressure control unit 117.

The XYZ table 103 has a bed plate 301, an X-axis slide guide 303, an X-axis slider 305, a Y-axis support frame 311, a Y-axis slide guide 313, a Y-axis slider 315, a Z-axis support frame 321, a Z-axis slide guide 323, and a Z-axis slider 325.

The bed plate 301 is fixed to a top surface of the placing pedestal 102 while the X-axis slide guide 303 is fixed to a top surface of the bed plate 301, and the X-axis slider 305 is driven by a ball screw drive mechanism and movable along the X-axis slide guide 303. The ball screw drive mechanism rotationally drives a ball screw shaft with a motor to move a ball screw nut screwed to the ball screw shaft in the axial direction of the ball screw shaft.

The Y-axis support frame 311 is fixed to the X-axis slider 305 while the Y-axis slide guide 313 is fixed to the Y-axis support frame 311, and the Y-axis slider 315 is driven by a ball screw drive mechanism and movable along the Y-axis slide guide 313. The Z-axis support frame 321 is fixed to the Y-axis slider 315 while the Z-axis slide guide 323 is fixed to the Z-axis support frame 321, and the Z-axis slider 325 is driven by a ball screw drive mechanism and movable along the Z-axis slide guide 323. Therefore, the Z-axis slider 325 is movable in each of the XYZ-directions and the application heads 1 attached to the Z-axis slider 325 are also movable in each of the XYZ-directions.

An overall operation of this apparatus will generally be described. First, the substrate 111 is supplied as an object to be coated to a carry-in portion 91 of the carrying unit 109 of FIG. 10. The substrate 111 is carried from the carry-in portion 91 to an applying portion 95 and positioned at a predetermined position. The application heads 1 are supported by the XYZ table 103 and moved above the applying portion 95 (above the substrate 11) and apply liquid material to the substrate 111. After the applying operation is completed, the substrate 111 is carried to a carry-away portion 97 and ejected. If needed, a preheating portion may be disposed on a stage before the applying portion 95 to increase the temperature of the substrate 111 with a preheating means such as a heater and a cooling portion may be disposed on a stage after the applying portion 95 to reduce the temperature of the substrate 111 so as to solidify and stabilize the applied liquid. After performing the applying operation for a predetermined number of the substrates 111, the application heads 1 are retracted in the Y-direction and the applying operation is terminated.

(Modification) While both the storage-side valve 13*a* and the discharge-side valve 13*b* are in the communicating state and the plunger is fixed, a predetermined pressure can be applied to the storage unit 50 for a predetermined time to cause the application head to act as a known air type dispenser. This is preferred when it is desired to achieve continuous application with the same width not requiring higher accuracy such as dam formation. The present invention can be used in this way and is characterized by a broad application range.

According to the embodiment, the following effects are achieved.

(1) Unlike the method using the non-return valves of the first patent document, an accurate application amount (discharge amount) as required in the electronic components industry can be realized. A droplet applying apparatus with higher accuracy and higher processing capacity can be provided to enable not only application of adhesive and resin but also high-speed execution of highly-accurate filling of crystal phosphor etc.

(2) The structure using the storage-side valve 13*a* and the discharge-side valve 13*b* controlled independently of each other can prevent the disadvantages (poor maintenance property and difficulty in air removal) cause by a structure in which a concave groove and a through-hole of single switching valve function as the supply side and the discharge side, respectively, as in the second patent document. Specifically, in this embodiment, both the storage-side valve 13*a* and the discharge-side valve 13*b* can be in the communicating state during the same period in the application head 1 and, therefore, when the liquid passage is washed, favorable maintenance property is realized because the entire liquid passage to the nozzle 16 can be washed at one time by pressing a solvent from the upper side, and the air removal operation before discharge can easily and quickly be performed in a preferable manner. In this regard, in the second patent document, since only one state of the switching valve (either communication only on the storage side or communication only on the discharge side) can be selected, the liquid passage cannot be washed at one time as in this embodiment and the air removal is difficult.

(3) The application head 1 is disassembled and cleaned from the front side of the apparatus, resulting in favorable maintenance property. If the application heads 1 are sequentially arranged, a narrower pitch can be realized to achieve improvement in processing capacity. And the favorable maintenance property is not changed even if a plurality of the application heads is sequentially arranged. In this regard, in the case of the second patent document, since the switching valve is driven by a chain and a sprocket on the back side and the plunger is inserted in the vertical direction in the figures, it is difficult to disassemble and clean the application head, which includes a section around the switching valve requiring maintenance, from the front side.

(4) Since the liquid passage of the discharging unit 10 has the structure forming a straight line downward from the tank 51 to the nozzle 16, the piping is not elongated due to air removal. In this regard, since fluid is flowed from the lower side to the upper side in a gravity direction for air removal in the first patent document, if an object to be coated is places on the lower side, the piping may be elongated.

(5) Since adhesive is applied between the storage-side bush 12*a* and the bush insertion hole 118*a* and between the discharge-side bush 12*b* and the bush insertion hole 118*b* without a gap, a liquid leak from a gap is smaller as compared to the case of pressing the storage-side bush 12*a* and the discharge-side bush 12*b* into the bush insertion holes 118*a* and 118*b*, which is advantageous for achieving higher accuracy of an application amount.

(6) Since no seal member is disposed between the through-holes 120*a*, 120*b* of the storage-side and discharge-side bushes 12*a*, 12*b* and the storage-side and discharge-side valves 13*a*, 13*b*, the volume of the liquid in the liquid passage is not changed due to the elasticity of the seal member, which is advantageous for achieving higher accuracy of an application amount (a very slight leak of liquid attributable to the absence of use of the seal member has a smaller effect on an application amount as compared to a volume change of the liquid due to the elasticity of the seal member).

(7) Since the storage-side valve 13*a*, the discharge-side valve 13*b*, the storage-side bush 12*a*, and the discharge-side bush 12*b* are made of silicon carbide, a liquid material with higher hardness can be handled as in the case of the LED-phosphor potting. In the case of the LED-phosphor potting, even cemented carbide such as tungsten carbide may be scraped, causing the phenomenon in which black fine powder enters the phosphor. However, if the hardness of the liquid material is not high, the valves and bushes made of not only silicon carbide but also alumina (ceramics) or cemented carbide may be used.

Second Embodiment

Figure 11:
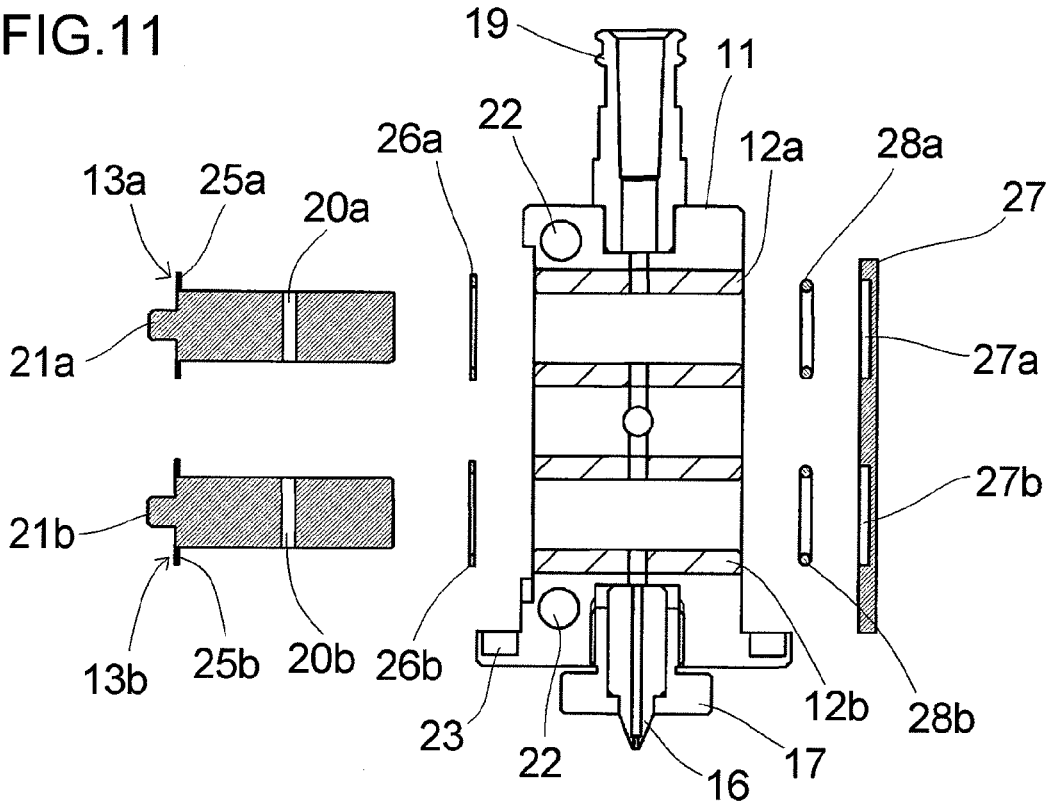
FIG. 11 is an exploded perspective view of a main portion of an application head according to a second embodiment of the present invention.
Figure 12:
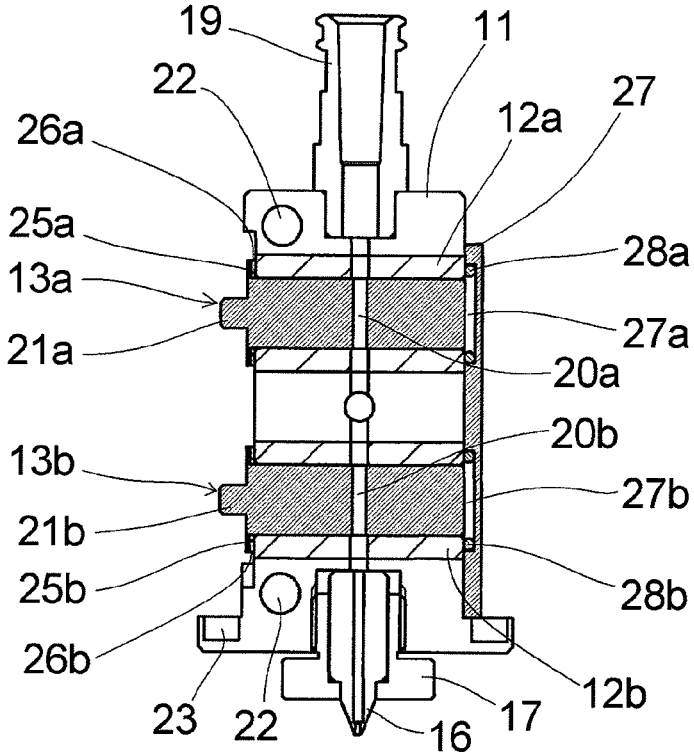
FIG. 12 is a side cross-sectional view thereof.
Figure 13:
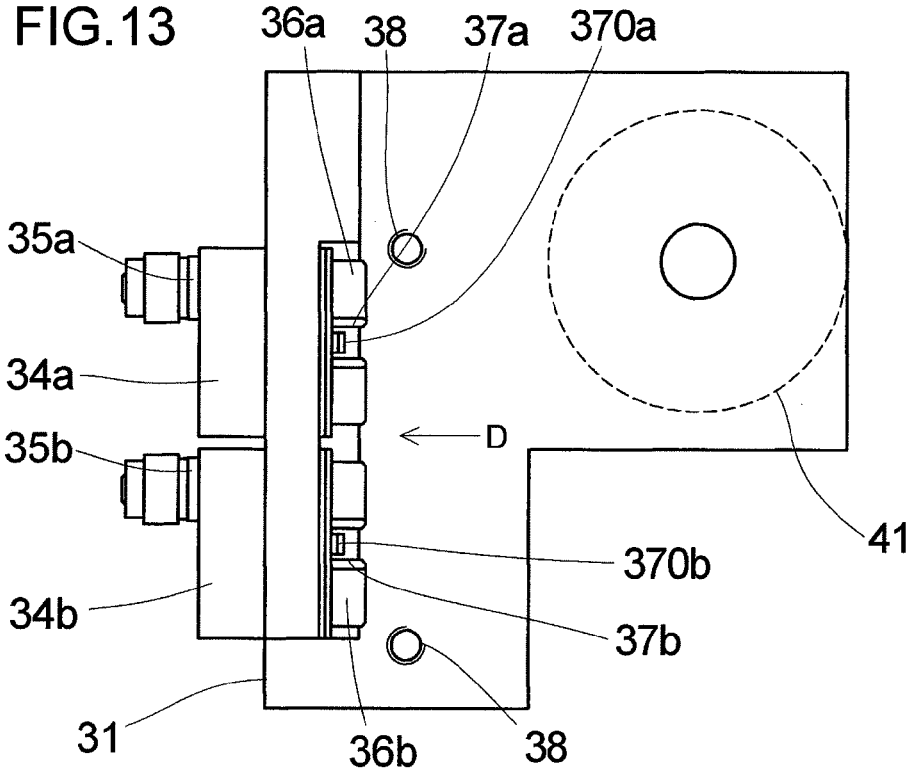
FIG. 13 is a side view of a configuration of valve drive according to the second embodiment.
Figure 14:
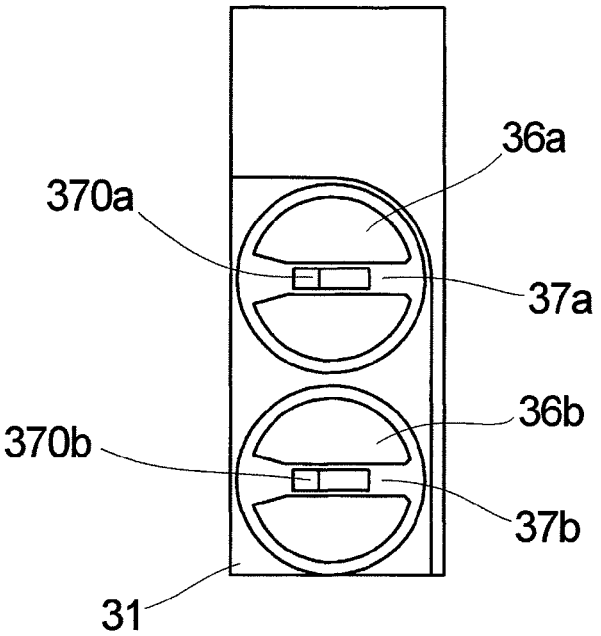
FIG. 14 is an arrow view of FIG. 13 along an arrow D.
Figure 15:
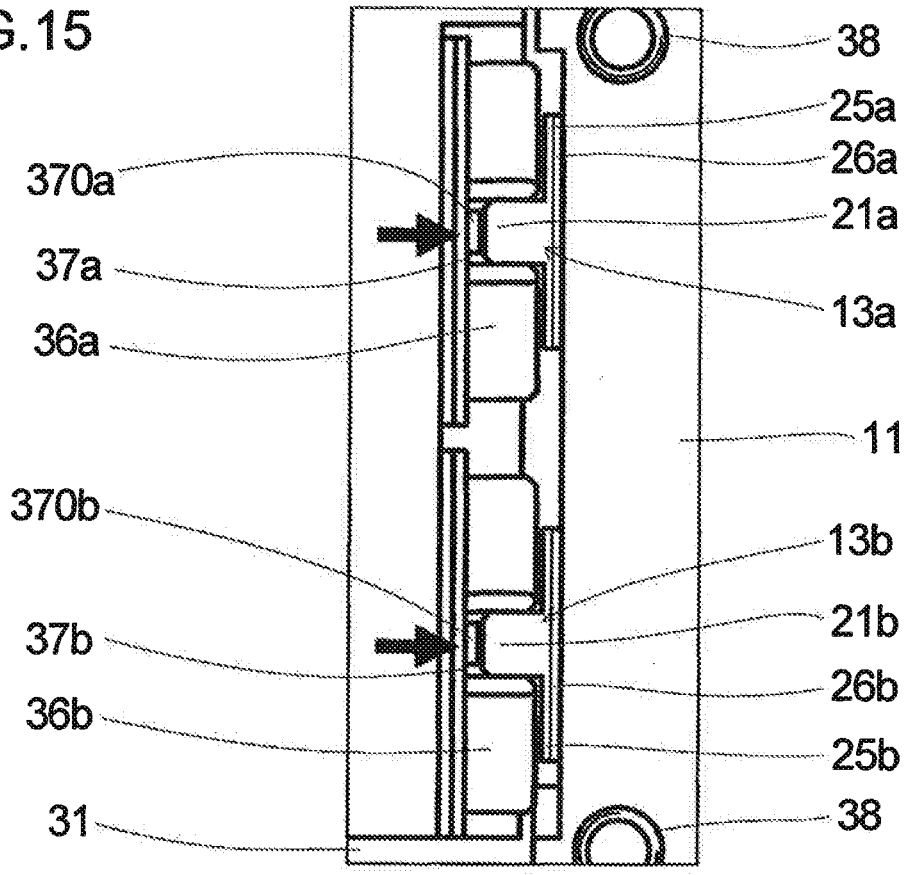
FIG. 15 is an enlarged view of fitting configuration between a storage-side valve and a driving unit thereof and between a discharge-side valve and a driving unit thereof according to the second embodiment.
Figure 16:
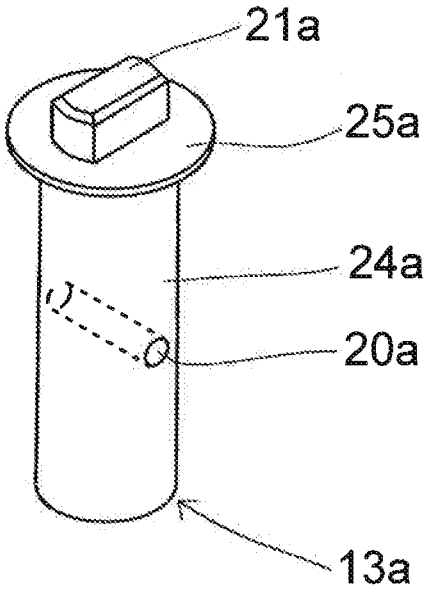
FIG. 16 is a perspective view of the storage-side valve according to the second embodiment.

FIG. 11 is an exploded perspective view of a main portion of an application head according to a second embodiment of the present invention. FIG. 12 is a side cross-sectional view thereof. FIG. 13 is a side view of a configuration of valve drive according to the second embodiment. FIG. 14 is an arrow view of FIG. 13 along an arrow D. FIG. 15 is an enlarged view of fitting configuration between a storage-side valve 13*a* and a driving unit thereof and between a discharge-side valve 13*b* and a driving unit thereof according to the second embodiment. FIG. 16 is a perspective view of the storage-side valve 13*a* according to the second embodiment. The application head according to the second embodiment includes, in addition to the configuration of the first embodiment, configuration to prevent leak of liquid from between the storage-side bush 12*a* and the storage-side valve 13*a* and between the discharge-side bush 12*b* and the discharge-side valve 13*b*.

First seal members 28*a*, 28*b* are set in concave portion 27*a*, 27*b* of a pressing plate 27, respectively. The first seal members 28*a*, 28*b* are ring-like elastic members, for example O-rings, packings, or washers made of rubber. The first seal members 28*a*, 28*b* may be tapes made of Teflon®, silicone, or DURACON®. The pressing plate 27 is a metal plate, for example. The pressing plate 27 may be a resin plate. The pressing plate 27 is attached and fixed to a surface of the block 11 by screws etc. The first seal members 28*a*, 28*b* are sandwiched between the block 11 and the pressing plate 27 to be compressed. The first seal members 28*a*, 28*b* surround entire circumferences of a gap between the storage-side bush 12*a* and the storage-side valve 13*a* and a gap between the discharge-side bush 12*b* and the discharge-side valve 13*b*, respectively, to be liquid hermetic seals for liquid. The first seal members 28*a*, 28*b* may cover entire circumferences of the gap between the storage-side bush 12*a* and the storage-side valve 13*a* and the gap between the discharge-side bush 12*b* and the discharge-side valve 13*b*, respectively.

The storage-side valve 13*a* and the discharge-side valve 13*b* have flange parts 25*a*, 25*b*, respectively. As shown in FIG. 16, the flange part 25*a* projects outward from whole circumference of one end of the column-shaped unit 24*a*. The flange part 25*b* projects in the same manner as the flange part 25*a*. A second seal member 26*a* is set between the flange part 25*a* and the storage-side bush 12*a* or a surface of the block 11. A second seal member 26*b* is set between the flange part 25*b* and the discharge-side bush 12*b* or a surface of the block 11. The second seal members 26*a*, 26*b* are preferably lubricating ring-like elastic members, for example ring-like tapes made of Teflon® or silicone. The second seal members 26*a*, 26*b* may be washers made of elastic member (e.g., rubber) whose surface are fabricated to have lubricity. However, considering tolerance for organic solvent, Teflon® is preferable.

As shown in FIG. 13 and FIG. 14, pressing members 370*a*, 370*b* are provided on bottom surfaces of fitting grooves 37*a*, 37*b*, respectively. The pressing members 370*a*, 370*b* elastically press fitting convex portions 21*a*, 21*b* (end parts of the flange part side of the storage-side valve 13*a* and the discharge-side valve 13*b*) toward block 11, respectively. The fitting grooves 37*a*, 37*b* engage with the fitting convex portions 21*a*, 21*b* of the storage-side valve 13*a* and the discharge-side valve 13*b*, respectively. The pressing members 370*a*, 370*b* are elastic members, for example leaf springs, coil springs, or rubber. The second seal member 26*a* is sandwiched between the flange part 25*a* and the storage-side valve 13*a* and is compressed by pressing force of the pressing members 370*a*. Similarly, the second seal member 26*b* is sandwiched between the flange part 25*b* and the discharge-side valve 13*b* and is compressed by pressing force of the pressing members 370*b*. Thus, the second seal members 26*a*, 26*b* surround entire circumferences of a gap between the storage-side bush 12*a* and the storage-side valve 13*a* and a gap between the discharge-side bush 12*b* and the discharge-side valve 13*b*, respectively, to be liquid hermetic seals for liquid.

According to the second embodiment, liquid leak from the gap between the storage-side bush 12*a* and the storage-side valve 13*a* and the gap between the discharge-side bush 12*b* and the discharge-side valve 13*b* can be prevented or reduced, due to sealing effects by the first seal members 28*a*, 28*b* and the second seal members 26*a*, 26*b*, even in the case of long-time use or applying low-viscosity liquid (resin). And, as the second seal members 26*a*, 26*b* are compressed by elastic pressing force of the pressing members 370*a*, 370*b*, while sealing effects of the second seal members 26*a*, 26*b* are retained, lubricity (slidability) thereof required not to prevent rotation of the storage-side valve 13*a* and the discharge-side valve 13*b* are also retained. And, as the first seal members 28*a*, 28*b* and the second seal members 26*a*, 26*b* are set outside the block 11, there are no disadvantages that a conduit line capacity is changed and that removable of air becomes difficult, unlike such a sealing structure that O-rings are sandwiched in a gap between the storage-side bush 12*a* and the storage-side valve 13*a* and a gap between the discharge-side bush 12*b* and the discharge-side valve 13*b*, respectively. The other points of the second embodiment and the effects thereof are the same as the first embodiment.

Described above is an explanation based on the embodiment. The description of the embodiments is illustrative in nature and various variations in constituting elements and processes involved are possible. Those skilled in the art would readily appreciate that such variations are also within the scope of the present invention.

What is claimed is:

1. An application head comprising:

a liquid storage unit storing a liquid and having a predetermined pressure applied inside;

a tip discharge opening discharging a droplet;

a liquid passage from the liquid storage unit to the tip discharge opening;

a storage-side valve inserted into the liquid passage;

a discharge-side valve inserted in the liquid passage on a downstream side relative to the storage-side valve; and a plunger sliding in a space in communication with an intermediate liquid passage that is a liquid passage between the storage-side valve and the discharge-side valve and changing volume of a liquid in the intermediate liquid passage, wherein each of the storage-side valve and the discharge-side valve has a column-shaped part, including a through-hole penetrating outer circumferential surfaces of the column-shaped part, and is rotatable at least within a predetermined angular range around a center axis of the column-shaped part, and each of the through-holes of the storage-side valve and the discharge-side valve communicates with the liquid passage on both sides at a predetermined rotational position and does not communicate with the liquid passage on both sides at rotational positions outside the predetermined rotational position.

2. The application head according to claim 1 capable of a discharge operation of discharging a predetermined amount of a droplet from the tip discharge opening by utilizing a volume change of the liquid in the intermediate liquid passage, wherein the volume change is made by, after air removal of the liquid passage from the liquid storage unit to the tip discharge opening, moving the plunger in a direction of retraction from inside the intermediate liquid passage while the storage-side valve is in a communicating state and the discharge-side valve is interrupted, and subsequently moving the plunger in a direction of protrusion into the intermediate liquid passage while the storage-side valve is interrupted and the discharge-side valve is in a communicating state.

3. The application head according to claim 2 capable of slightly moving the liquid at the tip discharge opening in a suction direction by slightly moving the plunger in the direction of retraction from inside the intermediate liquid passage after the discharge operation.

4. The application head according to claim 1, wherein both the storage-side valve and the discharge-side valve are capable of being in a communicating state during the same period.

5. The application head according to claim 1 capable of continuous application by moving and applying a discharge pressure to the liquid in the liquid storage unit while both the storage-side valve and the discharge-side valve are in a communicating state.

6. The application head according to claim 5 capable of slightly moving the liquid at the tip discharge opening in a suction direction by slightly moving the plunger in a direction of retraction from inside the intermediate liquid passage after release of the discharge pressure in the continuous application.

7. The application head according to claim 1 capable of completing an air removal operation achieving a state in which the liquid passage from the liquid storage unit to the tip discharge opening is filled with the liquid by reciprocating the plunger a plurality of times while both the storage-side valve and the discharge-side valve are in a communicating state.

8. The application head according to claim 1, wherein when both the storage-side valve and the discharge-side valve are in a communicating state, the liquid passage from the liquid storage unit to the tip discharge opening lies on a downward straight line.

9. The application head according to claim 1 comprising an actuator independently driving each of the storage-side valve and the discharge-side valve, wherein each of the storage-side valve and the discharge-side valve has a first fitting portion, the actuator operates a second fitting portion engaged with each of the first fitting portions with a driving unit to operate each of the storage-side valve and the discharge-side valve, and the first fitting portion and the second fitting portion are attachable to and detachable from each other.

10. The application head according to claim 9, wherein the first fitting portion is attachable to and detachable from the second fitting portion upon direction of an operator.

11. The application head according to claim 10, wherein the first fitting portion is a rectangular fitting convex portion, the second fitting portion is a fitting groove, and upon the attachment and detachment, the fitting convex portion is pulled out in a horizontal direction when the fitting groove is oriented substantially horizontally.

12. The application head according to claim 11, wherein the fitting convex portion can be pulled out substantially horizontally, when the discharge-side valve is closed.

13. The application head according to claim 11, wherein the fitting convex portions are rounded at four corners when viewed from an axial direction of the storage-side valve and the discharge-side valve.

14. The application head according to claim 1, comprising an actuator advancing and retracting the plunger relative to the intermediate liquid passage, wherein the plunger is clamped by a clamp and fixed to a movable portion of the actuator, and the plunger may be separated from the actuator when the clamp is loosened and retracted.

15. The application head according to claim 14, wherein the plunger is attachable to and detachable from the actuator upon direction of an operator.

16. The application head according to claim 1, comprising a block having a through-hole as the liquid passage between the liquid storage unit and the tip discharge opening, and having two bush insertion holes crossing the through-hole, and a storage-side bush and a discharge-side bush having the storage-side valve and the discharge-side valve respectively inserted rotatably within a predetermined angular range, wherein each of the storage-side bush and the discharge-side bush includes a through hole located on a side surface as a portion of the liquid passage, and are, respectively, inserted into the two bush insertion holes.

17. The application head according to claim 16, including an adhesive between each of the storage-side and discharge-side bushes, and each of the two bush insertion holes, without a gap.

18. The application head according to claim 16 comprising a liquid pool on a lower portion of the block for receiving liquid when the liquid seeps out from a gap between each of the storage-side and discharge-side bushes and each of the storage-side and discharge-side valves.

19. The application head according to claim 16, wherein the storage-side and discharge-side bushes and the storage-side and discharge-side valves are silicon carbide.

20. The application head according to claim 16 comprising:

first seal members surrounding or covering a gap between the storage-side bush and the storage-side valve and a gap between the discharge-side bush and the discharge-side valve, respectively, on at least one end side of each of the storage-side bush and the discharge-side bush; and a pressing plate attached to the block and pressing on the first seal members.

21. The application head according to claim 16 wherein each of the storage-side valve and the discharge-side valve includes a flange part, and the application head comprises second seal members sandwiched between the flange part of the storage-side valve and an end part of the storage-side bush or a surface of the block and between the flange part of the discharge-side valve and an end part of the discharge-side bush or a surface of the block.

22. The application head according to claim 16 comprising:

first seal members surrounding or covering a gap between the storage-side bush and the storage-side valve and a gap between the discharge-side bush and the discharge-side valve, respectively, on at least one end side of each of the storage-side bush and the discharge-side bush; and a pressing plate attached to the block and pressing the first seal members, wherein each of the storage-side valve and the discharge-side valve includes a flange part, and the application head comprises second seal members sandwiched between the flange part of the storage-side valve and an end part of the storage-side bush or a surface of the block and between the flange part of the discharge-side valve and an end part of the discharge-side bush or a surface of the block.

23. The application head according to claim 21 wherein the second seal members are lubricating.

24. The application head according to claim 21 comprising a pressing member which elastically presses end parts of the flange part side of the storage-side valve and the discharge-side valve, respectively.

25. A droplet application apparatus comprising:

at least one application head; and means of moving the application head, relative to an object to be coated, in X, Y, and Z directions that are different from each other, wherein the application head comprises:

a liquid storage unit storing a liquid and having a predetermined pressure applied inside;

a tip discharge opening discharging a droplet;

a liquid passage from the liquid storage unit to the tip discharge opening;

a storage-side valve inserted into the liquid passage;

a discharge-side valve inserted in the liquid passage on a downstream side, relative to the storage-side valve; and a plunger sliding in a space in communication with an intermediate liquid passage between the storage-side valve and the discharge-side valve and changing volume of liquid in the intermediate liquid passage, wherein each of the storage-side valve and the discharge-side valve has a column-shaped part, includes a through-hole penetrating between outer circumferential surfaces of the column-shaped part, and is rotatable within a predetermined angular range, around a center axis of the column-shaped part, and each of the through-holes of the storage-side valve and the discharge-side valve communicates with the liquid passage on both sides at a predetermined rotational position and does not communicate with the liquid passage on both sides at rotational positions outside the predetermined rotational position.

* * * * *